US009057376B2

(12) United States Patent
Thut

(10) Patent No.: US 9,057,376 B2
(45) Date of Patent: Jun. 16, 2015

(54) TUBE PUMP FOR TRANSFERRING MOLTEN METAL WHILE PREVENTING OVERFLOW

(71) Applicant: Bruno H. Thut, Chagrin Falls, OH (US)

(72) Inventor: Bruno H. Thut, Chagrin Falls, OH (US)

( * ) Notice: Subject to any disclaimer, the term of this patent is extended or adjusted under 35 U.S.C. 154(b) by 132 days.

(21) Appl. No.: 13/916,697

(22) Filed: Jun. 13, 2013

(65) Prior Publication Data

US 2014/0369860 A1 Dec. 18, 2014

(51) Int. Cl.
*F04D 7/06* (2006.01)
*F04D 29/08* (2006.01)
*F04D 29/70* (2006.01)

(52) U.S. Cl.
CPC ..... *F04D 7/065* (2013.01); *F04D 29/086* (2013.01); *F04D 29/708* (2013.01)

(58) Field of Classification Search
CPC ..... F04D 7/065
USPC ..... 417/423.3, 423.11, 42.1
See application file for complete search history.

(56) References Cited

U.S. PATENT DOCUMENTS

| | | | | |
|---|---|---|---|---|
| 2,468,704 | A * | 4/1949 | Pippin | 417/423.12 |
| 4,169,584 | A * | 10/1979 | Mangalick | 266/214 |
| 4,351,514 | A | 9/1982 | Koch | |
| 4,435,132 | A * | 3/1984 | Haesloop et al. | 417/360 |
| 4,931,091 | A | 6/1990 | Waite et al. | |
| 4,954,167 | A | 9/1990 | Cooper | |
| 5,203,681 | A | 4/1993 | Cooper | |
| 5,676,520 | A | 10/1997 | Thut | |
| 5,678,807 | A | 10/1997 | Cooper | |
| 6,123,523 | A | 9/2000 | Cooper | |
| 6,217,632 | B1 | 4/2001 | Megy | |
| 6,689,310 | B1 | 2/2004 | Cooper | |
| 7,476,357 | B2 | 1/2009 | Thut | |
| 7,507,365 | B2 | 3/2009 | Thut | |
| 7,534,284 | B2 * | 5/2009 | Thut et al. | 75/684 |
| 7,669,739 | B2 | 3/2010 | Schmeisser | |
| 7,858,020 | B2 | 12/2010 | Thut | |
| 8,246,295 | B2 | 8/2012 | Morando | |

(Continued)

FOREIGN PATENT DOCUMENTS

| | | |
|---|---|---|
| KR | 100749026 | 8/2007 |
| KR | 20120082275 | 7/2012 |

(Continued)

OTHER PUBLICATIONS

Christoph Schmitz, et al., Handbook of Aluminum Recycling, Burwitz Feuerungsbau GmbH, Peine, Germany 2006, pp. 80-91.

Brochure for Molten Metal Equipment Innovations Speed Demon Transfer Pump available on the internet at least as early as Jun. 13, 2013.

*Primary Examiner* — Peter J Bertheaud
(74) *Attorney, Agent, or Firm* — Pearne & Gordon LLP

(57) ABSTRACT

A tube pump for transferring molten metal includes a refractory tube having upper and lower end portions. A motor is disposed near the upper end portion of the refractory tube. A refractory shaft extends in the refractory tube and is connected to the motor near the upper end portion of the refractory tube. A refractory impeller is connected to the shaft in the lower end portion of the refractory tube. An upper outlet extends from upper end portion of the refractory tube through which molten metal flows upon rotation of the impeller. The refractory tube is enclosed at its upper end portion. A gas source flows gas into the refractory tube at or near its upper end portion under a pressure which prevents overflow of the molten metal above the outlet. Flux may be directed into the refractory tube alone or with gas.

9 Claims, 3 Drawing Sheets

(56) References Cited

U.S. PATENT DOCUMENTS

| | | | | |
|---|---|---|---|---|
| 8,281,964 | B2 | 10/2012 | Schmeisser | |
| 2002/0148328 | A1 | 10/2002 | Holz et al. | |
| 2010/0104415 | A1 | 4/2010 | Morando | |
| 2011/0142606 | A1 * | 6/2011 | Cooper | 415/200 |
| 2011/0163486 | A1 | 7/2011 | Cooper | |
| 2012/0163959 | A1 | 6/2012 | Morando | |

FOREIGN PATENT DOCUMENTS

| | | |
|---|---|---|
| WO | 2005103335 | 11/2005 |
| WO | 2011024290 | 3/2011 |

* cited by examiner

TUBE PUMP FOR TRANSFERRING MOLTEN METAL WHILE PREVENTING OVERFLOW

TECHNICAL FIELD

This disclosure pertains to a pump for pumping molten metal, the body of the pump being in the form of a tube which is used to transfer molten metal from a bath leading to a furnace, to a smaller vessel.

TECHNICAL BACKGROUND

Pumps for pumping molten metal of the type that include a motor driven impeller typically position the impeller on the end of a shaft inside an impeller chamber of an elongated base having an inlet and outlet from the impeller chamber. Upon rotation of the impeller, molten metal is drawn into the base into the impeller chamber and then travels to the outlet of the base. If the pump is a circulation or submerged discharge pump, the outlet of the base extends as a passageway to the outer surface of the base, which circulates the molten metal through a furnace or hearth, for example. If the pump is a transfer pump, the outlet can lead to a riser spaced apart from the shaft, which extends above the pump to a conduit which directs the molten metal to another location such as to a ladle or to a die casting machine. All of the components of the pump that are in the molten metal environment are typically made of refractory material such as graphite, ceramic, graphite with a ceramic covering or graphite impregnated with a refractory oxide.

One type of transfer pump for pumping molten metal is a tube pump that includes no elongated base with impeller chamber and typically has a smaller capacity than such a pump with base. The tube pump includes a refractory tube having upper and lower end portions. A motor is disposed near the upper end portion of the tube. A shaft extends in the tube and is connected to the motor near the upper end portion of the tube. An impeller is connected to the shaft in the lower end portion of the tube. An upper outlet transfer passageway extends from the tube. The tube is open at the upper end portion, for example, to access the coupling between the motor drive shaft and the pump shaft. These tube pumps are used to transfer molten metal from a bath of molten metal that circulates into a furnace, for example to a crucible. During operation, molten metal travels up the tube and out the outlet passageway. These pumps suffer from the disadvantage and danger of overflowing out the top such as when the impeller is rotated too fast. At a minimum, this can damage the coupling between the motor drive shaft and the pump shaft, or can rise into the motor itself damaging it. Molten metal splashing or overflow also presents an extreme hazard of injuring workers. It would be advantageous if these problems and dangers of tube pumps could be avoided.

When the molten metal is added to the crucible it may be transported to a flux station where a rotary degasser (e.g., a submerged rotor rotated on the end of a shaft having a passageway that feeds gas along the shaft and out the rotor) is used to add gas to the molten metal in the crucible. Flux is also added to the surface of the molten metal in the crucible and mixed upon rotation of the rotor. The flux is added to clean the molten metal.

Also, flux is typically added to molten metal circulating through the hearth or furnace by injecting the flux along with a gas stream through a lance operated by hand. The flux is used to clean the molten metal and is typically in particulate form. This process is cumbersome and hazardous to workers who have to be near the molten metal when operating the lance. Attempts to replace the hand lancing of flux addition by designing the pumps so as to receive the flux near the pump or inside the base have not been entirely successful. For example, flux conduits in which inert gas and particulate flux are injected through an inner passageway of the conduit on the order of an inch or less in diameter are ineffective in that they routinely become clogged.

Pumps of the type that include a base have been designed with a refractory shaft sleeve that extends between the motor support plate and the base. The shaft rotates inside the sleeve. Gas has been added into the shaft sleeve as disclosed in U.S. Pat. No. 5,676,520, and displaced the molten metal therein. However, the molten metal does not travel out an upper passage in the shaft sleeve of such a pump, but rather leaves an outlet of the lower base. The longstanding problem of how to effectively introduce flux instead of the hand lancing process remains unsolved with such pumps having bases, as well as with tube pumps having no bases. Moreover, to the knowledge of the inventor, gas has not been directed into the tube of a tube pump.

BRIEF DESCRIPTION

A first embodiment of the disclosure features a tube pump for transferring molten metal including the following features. A refractory tube has upper and lower end portions. A motor is disposed near the upper end portion of the refractory tube. A refractory shaft extends in the refractory tube and is connected to the motor near the upper end portion of the refractory tube. A refractory impeller is connected to the refractory shaft in the lower end portion of the refractory tube. An upper outlet extends from the upper end portion of the refractory tube. The refractory tube is enclosed at the upper end portion thereof. A gas source is connected at or near the upper end portion of the refractory tube that flows gas into the refractory tube under a pressure which prevents overflow of the molten metal above the outlet.

Referring to specific features of the first embodiment, a flux feeding device feeds flux (and optionally gas) into the tube. For example, particulate flux (and typically gas) travel together along a conduit from the flux feeding device and into the tube. The flux can be in any form but specifically is in a form of a particulate material. In particular, the flux feeding device feeds inert gas and particulate flux into the tube.

A second embodiment of the invention features a method of preventing overflow in a tube pump for transferring molten metal. The method provides the tube pump generally described above. The shaft is driven with the motor so as to rotate the impeller in the refractory tube. Molten metal is moved upward in the refractory tube and through the outlet as a result of the rotation of the impeller in the refractory tube. The gas flows into the refractory tube at a pressure which prevents overflow of the molten metal above the outlet.

Referring now to specific features of the second embodiment, a flux feeding device feeds flux (and optionally gas) into the tube. For example, particulate flux and typically gas travel together along a conduit from the flux feeding device and into the tube. The flux can be in any form but specifically is in a form of a particulate material. In particular, the flux feeding device feeds inert gas and particulate flux into the tube. The tube pump can be operated to transfer the molten metal from a bath of molten metal that communicates with a furnace, into another vessel, for example, a crucible or ladle. The refractory tube has an inner diameter (e.g., at least 4 inches) and the shaft has a given diameter, depending on the desired transfer pumping capacity, which inner tube diameter is a sufficient size that is believed will avoid clogging of the refractory tube with the flux.

Even if due to operator error there is fouling, which may damage the motor or coupling, this tube pump should still be safer than conventional tube pumps that are open on top in that molten metal will not be sprayed out the top of the pump during overflow.

It should be understood that the above Brief Description describes embodiments of the disclosure in broad terms while the following Detailed Description describes embodiments of the disclosure more narrowly and presents specific embodiments that should not be construed as necessary limitations of the invention as broadly defined in the claims. Many additional features, advantages and a fuller understanding of the invention will be had from the accompanying drawings and the Detailed Description that follows.

DETAILED DESCRIPTION

Figure 1:
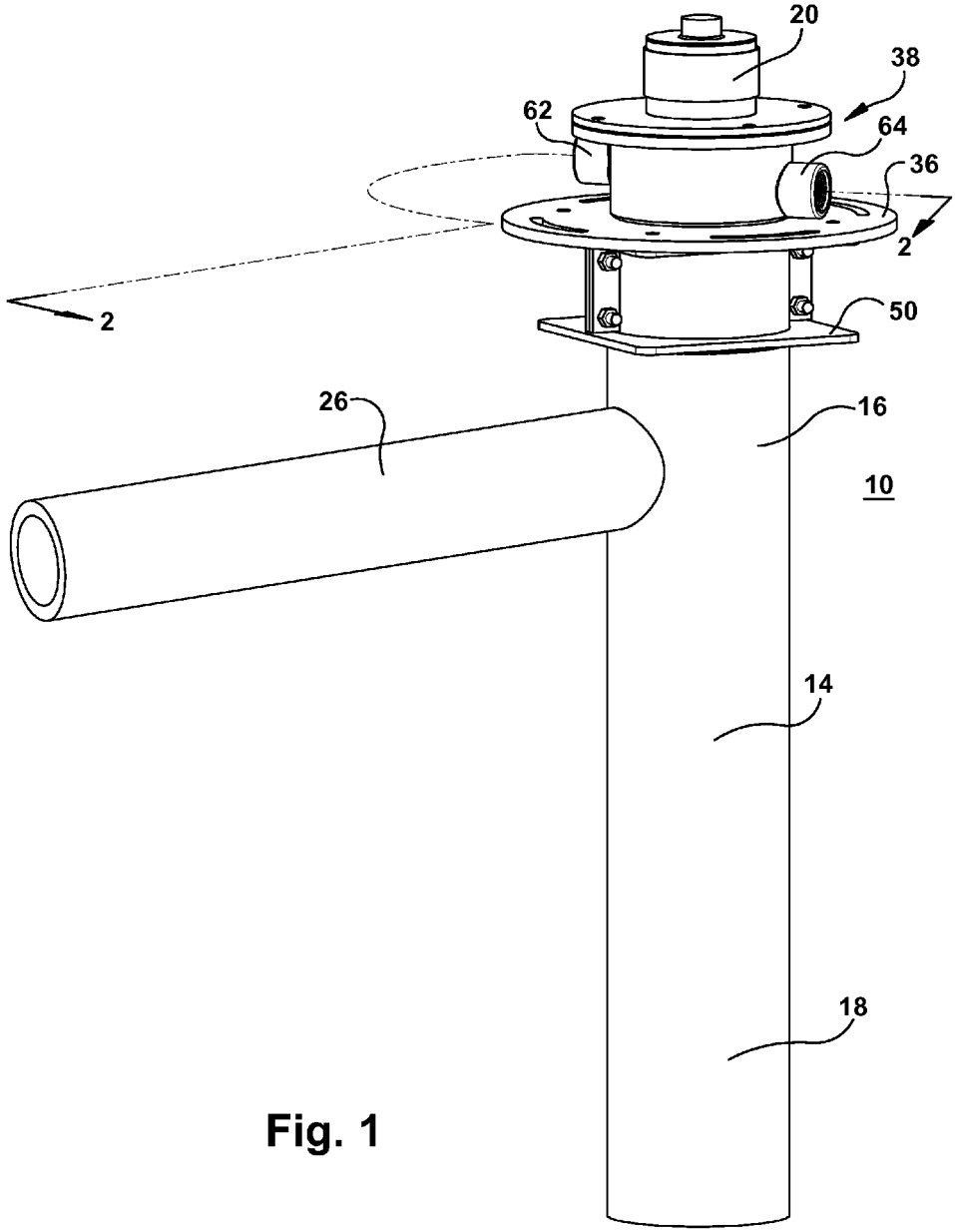
FIG. 1 is a perspective view of a tube pump according to this disclosure.
Figure 2:
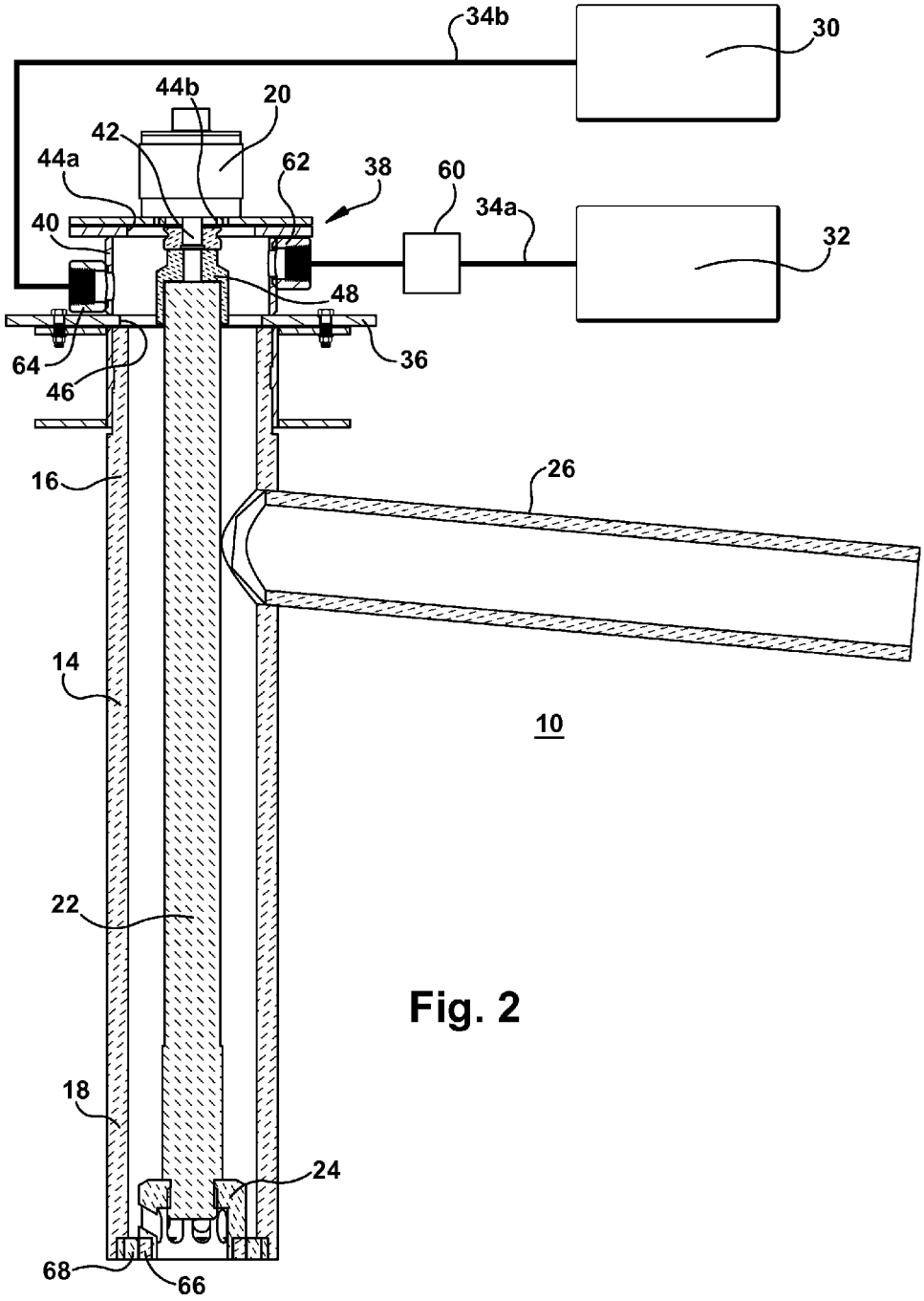
FIG. 2 is a vertical cross-sectional view of the tube pump of FIG. 1.
Figure 3:
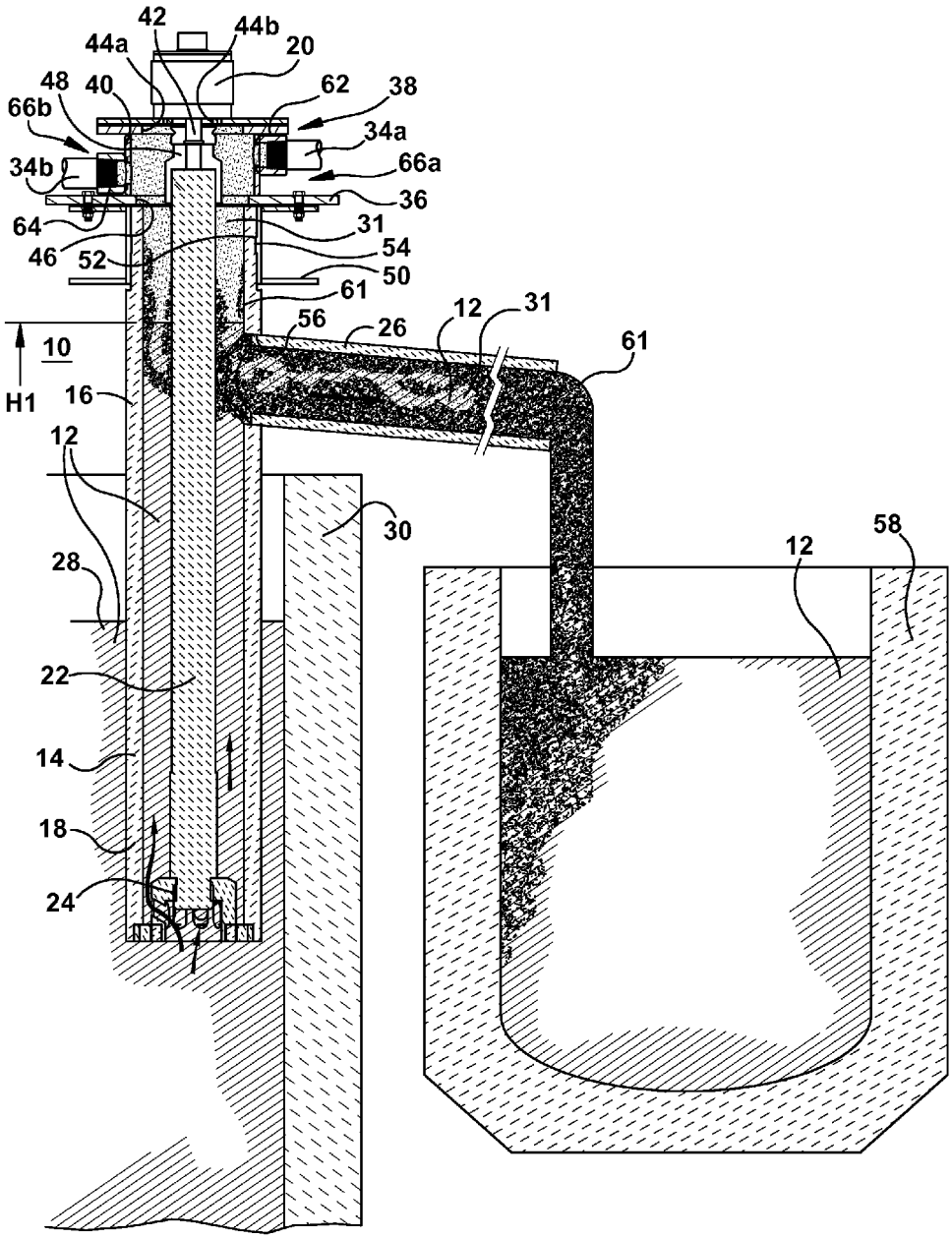
FIG. 3 is a vertical cross-sectional view showing the tube pump operating with the use of gas under pressure in the tube so as to prevent overflow of the molten metal while transferring the molten metal to another vessel, and optional delivery of flux into the vessel.

The tube pump 10 for transferring molten metal 12 includes a refractory tube 14 having upper and lower end portions 16, 18, respectively. A motor 20 (e.g., air or electric motor) is disposed near the upper end portion 16 of the refractory tube 14. A refractory shaft 22 extends in the refractory tube 14 and is connected to the motor 20 near the upper end portion 16 of the refractory tube. A refractory impeller 24 is connected to the refractory shaft 22 in the lower end portion 18 of the refractory tube 14. An upper outlet 26 extends from the refractory tube 14 at the upper location 16 thereof above the molten metal bath surface 28 in the vessel 30 that communicates with a hearth or furnace. The refractory tube 14 is enclosed at the upper end portion thereof as will be described below. A gas source 30 (e.g., a tank of pressurized inert gas) is connected to the tube pump that flows gas 31 (FIG. 3) into the refractory tube 14 under a pressure which prevents overflow of the molten metal above the outlet. An optional gas source 32 (e.g., a tank of pressurized inert gas) may also be used. Conduit 34*a*, 34*b* leads from each gas source to the tube pump. It should be appreciated that the gas in the conduit 34*a* can contact or entrain flux particles leaving the flux feeding device 60, rather than traveling through the device.

The tube pump includes a motor mount base plate 36. A motor adapter plate(s) 38 is spaced above the motor mount base plate 36. An upper tube or hollow member 40 extends between the motor mount base plate 36 and the motor adapter plate 38. The upper tube may include one or more closable windows or ports, which when opened, can permit one to access the coupling with tools. The motor mount base plate 36, the motor adapter plate 38 and the upper tube 40 can be composed of metal, for example, steel and can be fastened together in a known manner such as by welding. The motor 20 is affixed to the motor adapter plate 38. A drive shaft 42 of the motor extends into or near aligned openings 44*a*, 44*b* in the motor adapter plate 38 and opening 46 in the motor mount base plate 36. The refractory pump shaft 22 is connected to the drive shaft 42 with a coupling 48 as is known in the art. A metal quick disconnect member 50 is fastened to the bottom of the motor mount base plate 36 and includes a protrusion 52 that engages a slot 54 in the refractory tube in a manner known in the art. Thus, the member 50, when fastened to the bottom of the motor mount plate, releasably grips the refractory tube 14. The member 50 is fastened to the motor mount base plate and the two sections of the member are fastened together, using fasteners. The refractory upper outlet tube, or trough (launder) having no upper portion, 26, is cemented into an opening 56 in the refractory tube and extends from it. The outlet or trough may extend downwardly from the refractory tube to a smaller vessel which may be portable or not (e.g., a crucible or ladle) represented generally at 58.

A flux feeding device 60 known in the art can feed flux 61 and optionally gas 31 into the upper tube 40. The flux feeding device can sit on the floor outside the furnace. The upper tube 40 is disposed above the refractory tube 14. The upper tube 40, the motor mount base plate 36, the motor adapter plate 38 and the motor 20 form an enclosure about the upper end portion 16 of the refractory tube 14 so that it can be pressurized. The upper tube 40 can include a first port 62 and optional second port 64. The gas 31 travels from the gas source 32 into or near the flux feeding device 60 and the particulate flux and gas travel together along the conduit 34*a* from the flux feeding device 60 into the upper tube 40. The conduits 34*a*, 34*b* can be fastened to the respective first or second ports 62, 64 via a fitting shown generally at 66*a*, 66*b*, respectively (e.g., a threaded connection between the conduit and port). The view of the pump operating in FIG. 3 may be after flux flow has been shut off but while the gas flow continues. This illustrates how the tube pump can maintain the pressure by applying only gas and occasionally combine this with flux charging if desired.

Any molten metal can be processed according to the present disclosure but particular examples are aluminum, magnesium and zinc. A variety of fluxes 61 having different functions and chemistries can be employed depending on the metal that is treated and the function of the flux. The flux 61 can be in any form but specifically is in a form of a particulate material. Examples of flux 61 can be found in Ch. Schmitz, Handbook of Aluminum Recycling, 2006, which is incorporated herein by reference in its entirety. In particular, the flux feeding device feeds inert gas 31 and particulate flux 61 into the upper tube 40. Alternatively, it is possible to flow only gas 31 into the conduit 34*a* and/or the conduit 34*b* and into the upper tube 40. The gas 31 that flows into the second port 64 can replace or supplement the gas 31, or the gas 31 and the flux 61, traveling into the first port 62. The gas 31 only, the gas 31 and the flux 61, or the flux 61 only, travels from the upper tube 40 into the refractory tube 14. The gas 31 can be inert gas such as nitrogen or argon.

A method of preventing overflow in the tube pump includes connecting the gas source 30 and/or 32 to the tube pump 10 that flows gas into the upper tube 40 and the refractory tube 14 under pressure. This pressurizing occurs because the upper open end of the refractory tube 14 is enclosed. The pump shaft 22 is driven with the motor 20 so as to rotate the impeller in the refractory tube. A bearing ring 66 on the impeller is disposed inside a bearing ring 68 fastened to the lower end portion of the refractory tube 14. These bearing rings may be formed of abrasion resistant ceramic as known in the art. The engagement of the bearing rings centers the impeller for rotation in the refractory tube 14. The molten metal enters the bottom of the refractory tube through the bottom feed impeller. The molten metal is moved upwardly in the refractory tube 14 and through the outlet 26 as a result of the rotation of the impeller in the refractory tube. The tube pump is operated to transfer the molten metal from the bath of molten metal that communicates with a furnace, into another smaller vessel—a crucible or ladle, for example. From this other vessel the molten metal can be moved to a location for further processing such as to a pot feeding a die casting machine.

The gas 31 flows into the upper tube 40 and the refractory tube 14 at a pressure which prevents overflow of the molten metal above the outlet 26. A suitable gas pressure can be 0 to 5 psi, for example, and in particular, from 1 to 5 psi, for molten aluminum. Pressures higher than 5 psi may be used when pressurizing the refractory tube in connection with molten metal such as zinc having a higher density than molten aluminum. The gas pressure may also be affected by how deep the pump is immersed in the molten metal. The pressurized gas may force the molten metal lower in the refractory tube than it would ordinarily be while the motor is operating. An example of a height of the molten metal 12 inside the refractory tube 14 during normal operation is shown approximately in FIG. 3. The gas 31 may enter through the first and/or second ports 62, 64 of the upper tube or elsewhere in the tube pump (such as in the upper end portion of the refractory tube) in a variation of the pump design shown in the drawings.

The pressurized gas 31 inhibits the molten metal 12 from overflowing into contact with the coupling 48 or motor 20. This provides a level of safety not possible with conventional tube transfer pumps for molten metal. In addition, if the variation of feeding flux 61 into the refractory tube 14 is employed, flux can flow into the smaller vessel as a result of the transfer pumping from the tube pump, for cleaning the molten metal in the smaller vessel. Normally, the molten metal in the crucible is taken to the flux station where flux is added with a rotary gas disperser. By adding flux in with the molten metal when filling the crucible during the transfer operation of the pump, the flux station and associated equipment can be eliminated, thereby reducing processing time and cost. This is another advantage of the tube pump of this disclosure compared to the prior art tube pumps.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A tube pump for transferring molten metal comprising:
- a refractory tube having upper and lower end portions;
- a motor disposed near the upper end portion of said refractory tube;
- a refractory shaft extending in said refractory tube and connected to said motor near the upper end portion of said refractory tube;
- a refractory impeller connected to said refractory shaft in the lower end portion of said refractory tube;
- an upper outlet extending from the upper end portion of said refractory tube through which molten metal flows upon rotation of the impeller;
- wherein said refractory tube is enclosed at the upper end portion thereof; and
- a gas source connected at or near the upper end portion of said refractory tube that flows gas into said refractory tube under a pressure which prevents overflow of the molten metal above said outlet.

2. The tube pump of claim 1 comprising a flux feeding device that feeds flux alone or with said gas into said refractory tube.

3. The tube pump of claim 2 wherein said flux is in a form of a particulate material.

4. The tube pump of claim 3 wherein said flux feeding device feeds inert said gas and said particulate flux into said tube.

5. A method of preventing overflow in a tube pump for transferring molten metal comprising:
- providing said tube pump of claim 1;
- driving said refractory shaft with said motor so as to rotate said refractory impeller in said refractory tube;
- moving molten metal upward in said refractory tube and through said outlet as a result of said rotation of said refractory impeller in said refractory tube; and
- flowing said gas into said refractory tube at a pressure which prevents overflow of the molten metal above said outlet.

6. The method of claim 5 wherein a flux feeding device feeds flux alone or flux and gas into said refractory tube.

7. The method of claim 6 wherein said flux is in a form of a particulate material.

8. The method of claim 7 wherein said flux feeding device feeds said particulate flux and inert said gas into said tube.

9. The method of claim 5 wherein said tube pump is operated to transfer the molten metal from a bath of molten metal that communicates with a furnace, into a crucible or ladle.

* * * * *